US008881827B2

(12) United States Patent
Bjerke

(10) Patent No.: US 8,881,827 B2
(45) Date of Patent: Nov. 11, 2014

(54) WELLHEAD HAVING AN INTEGRATED SAFETY VALVE AND METHOD OF MAKING SAME

(75) Inventor: Bjorn Bjerke, Alesund (NO)

(73) Assignee: West Oil Tools AS, Alesund (NO)

( * ) Notice: Subject to any disclaimer, the term of this patent is extended or adjusted under 35 U.S.C. 154(b) by 536 days.

(21) Appl. No.: 13/132,191

(22) PCT Filed: Nov. 30, 2009

(86) PCT No.: PCT/NO2009/000411

§ 371 (c)(1),
(2), (4) Date: Jun. 27, 2011

(87) PCT Pub. No.: WO2010/064922

PCT Pub. Date: Jun. 10, 2010

(65) Prior Publication Data

US 2011/0259597 A1 Oct. 27, 2011

(30) Foreign Application Priority Data

Dec. 2, 2008 (NO) ..... 20085014

(51) Int. Cl.

| | |
|---|---|
| ***E21B 7/12*** | (2006.01) |
| ***E21B 33/035*** | (2006.01) |
| ***E21B 33/043*** | (2006.01) |
| ***E21B 34/04*** | (2006.01) |

(52) U.S. Cl.

CPC ..... *E21B 33/0355* (2013.01); *E21B 33/043* (2013.01); *E21B 34/04* (2013.01)

USPC ..... 166/344; 166/347; 166/360; 166/368

(58) Field of Classification Search

USPC ..... 166/344, 347, 348, 360, 373, 382, 386, 166/86.1, 88.1, 75.14; 285/123.1

See application file for complete search history.

(56) References Cited

U.S. PATENT DOCUMENTS

| | | | | |
|---|---|---|---|---|
| 3,638,732 | A * | 2/1972 | Huntsinger et al. | 166/379 |
| 5,465,794 | A | 11/1995 | McConaughy et al. | |
| 5,555,935 | A * | 9/1996 | Brammer et al. | 166/88.1 |
| 5,865,250 | A * | 2/1999 | Gariepy | 166/375 |
| 5,992,527 | A * | 11/1999 | Garnham et al. | 166/379 |
| 6,050,339 | A * | 4/2000 | Milberger | 166/368 |
| 6,076,605 | A | 6/2000 | Lilley et al. | |
| 6,119,773 | A * | 9/2000 | Gariepy et al. | 166/88.1 |
| 6,244,348 | B1 | 6/2001 | Gariepy et al. | |
| 6,293,345 | B1 * | 9/2001 | Watkins | 166/368 |

(Continued)

FOREIGN PATENT DOCUMENTS

| | | |
|---|---|---|
| WO | WO 00/47864 | 8/2000 |

*Primary Examiner* — Matthew Buck
*Assistant Examiner* — Aaron Lembo
(74) *Attorney, Agent, or Firm* — Gable Gotwals

(57) ABSTRACT

A wellhead for subsea use and a method of making same where the wellhead is constituted by a body having a bore (3) therethrough and at least one side bore (9, 11) for provision of fluid communication through the wall of the wellhead (1), and where the wellhead (1) includes a pipe hanger (30) provided with a bore (34) therethrough and a side bore (36) for provision of fluid communication between a tubing string (9') connected to the pipe hanger (30) and one of the side bores (9) of the wellhead (1), where the wellhead (1) is provided with at least one internal safety valve (42, 44) arranged to be able to shut off fluid communication through the wellhead.

6 Claims, 2 Drawing Sheets

(56) References Cited

U.S. PATENT DOCUMENTS

Figure 1:
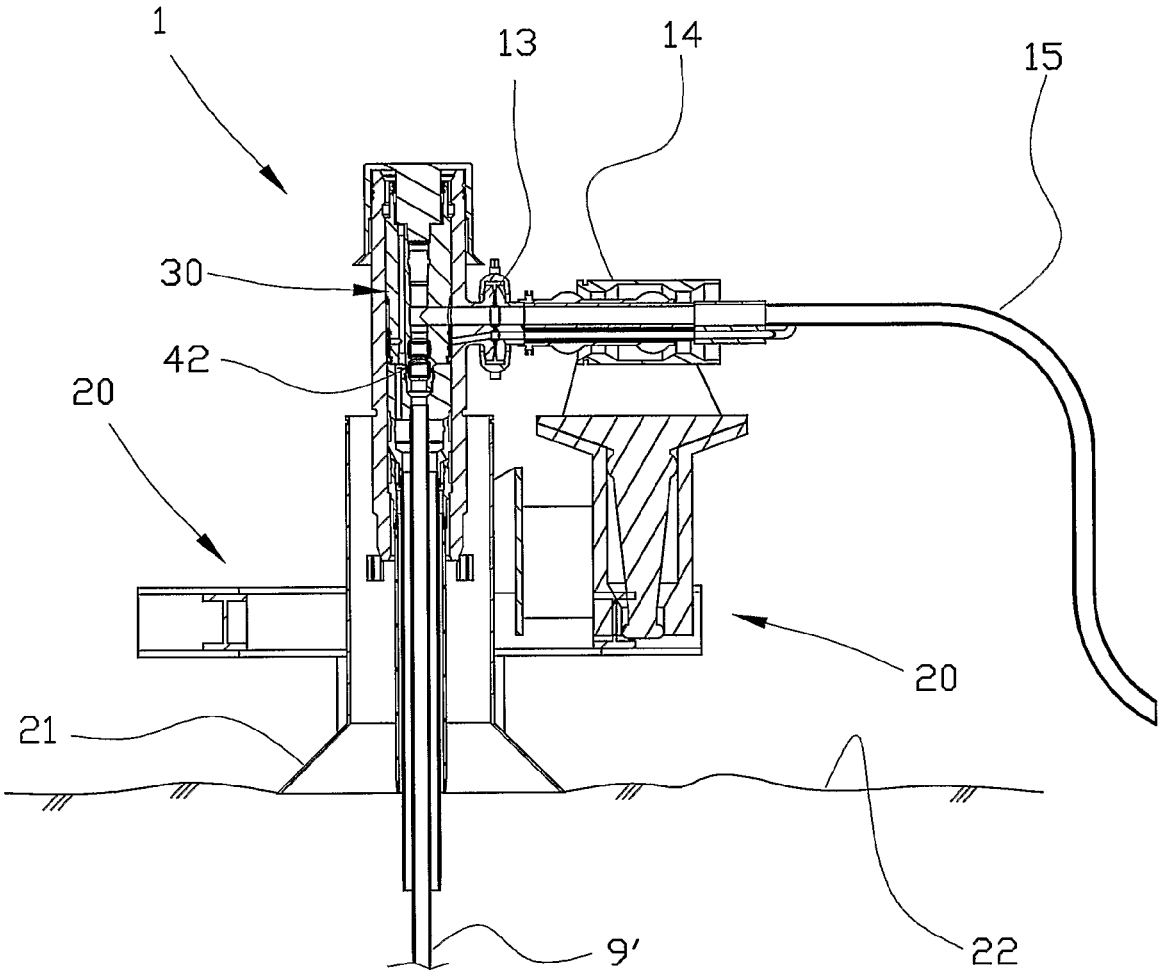

| | | | | |
|---|---|---|---|---|
| 6,343,654 | B1 * | 2/2002 | Brammer | 166/338 |
| 6,547,008 | B1 * | 4/2003 | Hopper et al. | 166/348 |
| 6,763,891 | B2 * | 7/2004 | Humphrey et al. | 166/368 |
| 6,913,240 | B1 | 7/2005 | MacKenzie | |
| 8,011,436 | B2 * | 9/2011 | Christie et al. | 166/359 |
| 2010/0006301 | A1 * | 1/2010 | Fenton | 166/368 |

* cited by examiner

WELLHEAD HAVING AN INTEGRATED SAFETY VALVE AND METHOD OF MAKING SAME

CROSS-REFERENCE TO RELATED APPLICATIONS

This application is the United States National Phase of PCT Patent Application No. NO2009/000411 filed on 30 Nov. 2009, which was published in English on 10 Jun. 2010 under Publication No. WO 2010/064922 A1, which claims priority to Norwegian Patent Application No. 20085014 filed 2 Dec. 2008, both of which are incorporated herein by reference.

The present invention relates to a wellhead. More particularly it concerns a wellhead for subsea use where the wellhead is constituted by a body having a bore therethrough and at least one side bore for providing fluid communication through the wall of the wellhead and where the wellhead includes a pipe hanger provided with a bore for provision of fluid communication between a pipe string connected to the pipe hanger and one of the side bores of the wellhead.

A person skilled in the art will know that a wellhead on a subsea well, such as is known from oil and gas exploitation offshore, is the top part of the well where the various casings are terminated and where the wellhead is the junction is for a christmas tree and a possible blowout valve, a so-called "bore BOP" on a subsea completed well.

A christmas tree used today is either a so-called horizontal christmas tree or a so-called vertical or conventional christmas tree. The difference between these two types of christmas trees is well known to a person skilled in the art and will for this reason not be discussed further in this document.

In what follows, the description is to a large extent directed toward production of fluids from petroleum well. It is however to be understood that the present invention equally well may be used in connection with a so-called injection well.

In the description indications of position such as "over/under" and "lower/upper" are related to the mutual positions the individual parts have in the figures.

In the cases where a wellhead is connected to a horizontal christmas tree a so-called production pipe string or production tubing may be pulled without the christmas tree having to be pulled. If there is a need to replace the christmas tree for example for maintenance reasons, this may not be done without also pulling the production tubing.

In the cases where a wellhead is connected to a vertical christmas tree the christmas tree may be pulled without the production tubing having to be pulled at the same time, but the production tubing may not be pulled without the christmas tree also having to be pulled.

Thus, both types of christmas tree have considerable drawbacks arising in connection with a need for pulling either the production tubing or the christmas tree. A person skilled in the art will know that a so-called BOP (Blow Out Preventer) or other type of well control device will have to be installed twice using horizontal or vertical christmas trees.

The publication U.S. Pat. No. 5,465,794 discloses a well production system and particularly a hydraulic seal between a pipe hanger and a wellhead element for provision of fluid to a hydraulic operated downhole safety valve. The safety valve is positioned in a production tubing string upstream of the wellhead of a production well. The wellhead is provided with a side outlet for production fluid.

The publication U.S. Pat. No. 6,076,605 discloses a wellhead having a production bore extending out through a side portion of the wellhead. The wellhead is secured by means of a christmas tree positioned over the wellhead.

The publication WO 00/47864 discloses a wellhead having a side outlet. A christmas tree is positioned on the outside of the wellhead.

Even if the above-mentioned publications solve some of the above-mentioned challenges that the traditional horizontal and vertical wellheads are infested with, the wellheads according to the above publications must still carry large and heavy christmas trees or valve blocks having dimension wise impact on the wellhead. Thus, both production, storage and handling of the christmas tree become more costly. A christmas tree of prior art will typically have a weight in the order of 35 tons and have a footprint of such as 4×4 meters.

It has long been a desire from the industry to be able to produce a wellhead with safety valves being best possibly protected against external influence. Particularly does this concern petroleum production offshore in environmentally tough and vulnerable areas such as off the coast of northern Norway and in areas further north.

The object of the invention is to remedy or reduce at least one of the prior art drawbacks.

The object is achieved by the features stated in the description below and in the following claims.

In a first aspect of the present invention there is provided a wellhead for use subsea, the wellhead being constituted by a body having a bore therethrough and at least one side bore for the provision of fluid communication through the wall of the wellhead, and the wellhead including a pipe hanger provided with a bore therethrough and a side bore for provision of fluid communication between a tubing string connected to the pipe hanger and one of the side bores of the wellhead, characterised in that the wellhead is provided with at least one internal isolation valve arranged to be able to shut off fluid communication through the wellhead such as in an emergency. The side bore provides a bore extending from the bore therethrough and through the wall of the pipe hanger.

The isolation valve is provided with a so-called "fail-safe-closed"-function so that the isolation valve is arranged to be able to block fluid communication through the wellhead. In the following the isolation valve is for this reason called a safety valve. The safety valve may for example be held in an open position by means of a driving force from a pressurised fluid and be closed if the fluid pressure falls below a predetermined level.

By placing the at least one safety valve constituting a part of the well control apparatus inside in the wellhead at the same time as the production bore is led through a side bore in the wellhead is it possible to provide the necessary barriers between the well and the exterior environment to complete and produce from a sub sea well without the need for a christmas tree. This has the great advantage that drilling and completion of a well may be carried out with only one installation operation of the BOP and that there is no need for large vessels to install a heavy christmas tree. By in addition moving elements for secondary functions normally also arranged on the christmas tree like such as, but not limited to so-called crossover valves, devices for flow measurement and control modules to an adjacent installation positioned on a separate foundation, it is possible to design a well head assembly for a production well or an injection well without the need for a prior art christmas tree assembly.

A typical procedure for establishing a well by means of the wellhead of the present invention will be as follows:

subsequent to installation of the wellhead in a way known per se the BOP is positioned with the purpose to be able to secure the well during drilling and installation of a casing string;

the pipe hanger is installed in the wellhead where the pipe hanger or a portion of the wellhead is provided with at least one safety valve;

a Surface-Controlled Subsurface Safety Valve (SCSSV) and the at least one safety valve positioned in the wellhead are closed whereafter a well isolation plug is installed in the upper portion of the wellhead;

the BOP is removed from the wellhead; and the necessary connections to external installations and to the control systems are established and the at least one safety valve and the SCSSV are opened so that the production from the well may start.

It is to be understood that in addition to the above certain test procedures and work operations will have to be carried out between the individual steps, which are not described. These will however be known to a person skilled in the art.

The pipe hanger may include an upper portion and a lower portion arranged to be able to be connected to or disconnected from each other in such a way that the upper portion may be pulled out of or inserted into the well head while at the same time the lower portion remains connected to the pipe string.

A pipe hanger including an upper portion and a lower portion will also be able to be installed at the same time in the wellhead.

Advantageously, the pipe hanger side bore is arranged in the upper portion of the pipe hanger.

Advantageously, at least one of the at least one safety valves in the wellhead is positioned in the upper portion of the pipe hanger in such a way that the through bore and side bore of the pipe hanger may be closed for fluid flow by means of the safety valve.

This has the effect that only the upper portion of the pipe hanger need to be pulled out of the wellhead if there is a need for access to the wellhead side bore an/or a need for maintenance of the safety valve. It is to be understood that an SCSSV position upstream must be closed before a pullout from a producing well takes place.

The at least one side bore includes a primary bore for fluid flow into or out of the well so that the fluid communication via the wellhead takes place through the side bore and not via the through bore of the well head.

In one embodiment the wellhead is further provided with at least one secondary bore for access to an annulus in the well. One or more annuli may thus be monitored for example to have control of whether the cementing of casing is sufficient.

Advantageously, at least one side bore extends through a flange arranged on the outside of the wellhead. This facilitates connection of such as a fluid flow line arranged to provide a fluid connection between the wellhead and an installation positioned at some distance from the wellhead.

In a second aspect of the present invention there is provided a method for making of a wellhead for subsea use, the wellhead being constituted by a body having a bore therethrough and at least one side bore for provision of fluid communication through the wellhead wall, the at least one safety valve being positioned inside the wellhead such that fluid flow through the wellhead may be closed when required, for example in an emergency.

Figure 2:
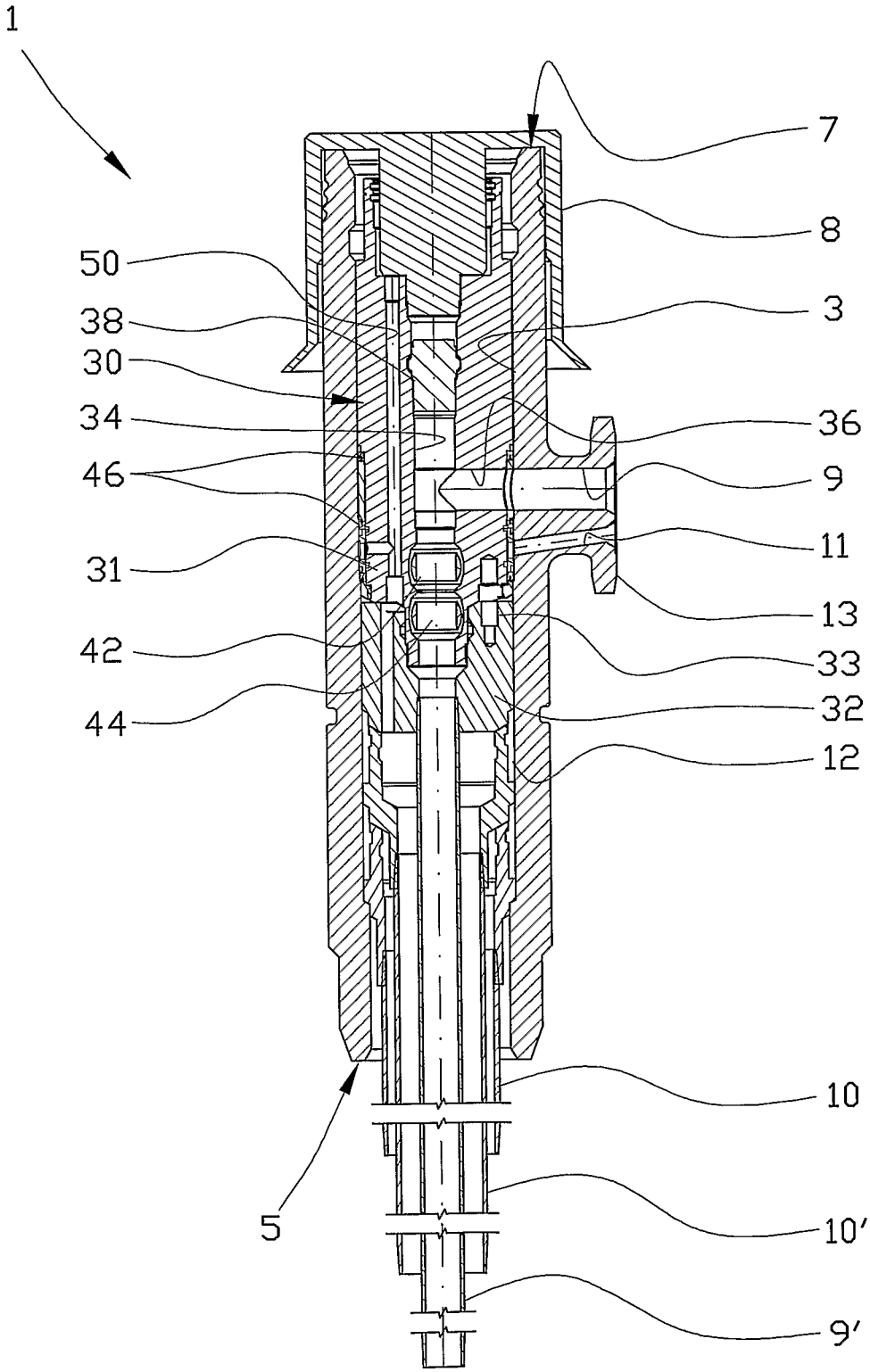

In the following is described an example of a preferred embodiment illustrated in the accompanying drawings, wherein:

FIG. 1 shows a cross-sectional view of a wellhead according to the present invention where the wellhead is positioned on a seabed well, and where the wellhead is provided with a side bore connected to a conduit; and FIG. 2 shows in a larger scale a cross-sectional side view of the wellhead of FIG. 1.

In the figures the reference numeral 1 denotes a wellhead attached to a support structure 20. The support structure 20 is attached to a frame, a so-called template 21 resting on the seabed 22.

The wellhead 1 is allocated a flange 13 forming a connection to a connecting point 14 between the wellhead 1 and a fluid line 15. The connecting point 14 thus forms a fluid connection between the wellhead 1 and a not shown installation positioned at a distance from the wellhead 1. The installation may for example, but not limited to, be a terminal plant for produced fluid, or an injection pump. The not shown installation is preferably supported by a relative to the wellhead 1 separate foundation and not by the wellhead 1 itself. The issue related to bending moment loads in the wellhead is thereby at least very much reduced.

Referring now to FIG. 2 the wellhead is shown in larger detail. The wellhead 1 is provided with a bore 3 therethrough extending between a first lower end portion 5 and a second upper end portion 7 of the wellhead 1. A sealing sleeve 8 is by means of a threaded connection attached to the upper end portion 7 of the wellhead 1. The sealing sleeve 8 contributes in isolating the interior of the wellhead 1 from the surrounding environment.

The wellhead 1 is provided with a primary bore 9 extending through the wall of the wellhead 1 in order to be able to provide a possibility for fluid communication therethrough.

The primary bore 9 is dimensionally adapted to for example a production tubing string 9' so that the well may be produced out through the primary bore 9.

Per se known casing hangers for support of casings 10, 10' are attached in a lower portion of the wellhead 1 trough bore 3.

In the embodiment shown the wellhead 1 is further provided with a secondary bore 11 arranged for access to an annulus 12 in the wellhead 1. Monitoring that cementing of casings 10, 10' is satisfactory will be possible by means of the secondary bore 11, as a leak will result in a fluid flow into the annulus 12.

In FIG. 2 is further shown a pipe hanger 30 positioned in the through bore 3 of the wellhead 1.

The pipe hanger 30 is fixed in the wellhead 1 in a way known per se by means of a holding means.

In the embodiment shown the pipe hanger 30 consists of an upper portion 31 and a lower portion 32.

The upper portion 31 and the lower portion 32 of the pipe hanger 30 are provided with a through bore 34 extending coaxially with the through bore 3 of the wellhead 1.

By means of an orientation means 33 known per se arranged in the upper portion 31 and the lower portion 32 of the pipe hanger 30 a correct mutual orientation between said portions is provided. In addition a per se known orientation means (not shown) is arranged between at least one of the upper portion 31 and/or lower portion 32 of the pipe hanger 30 and the internal bore 3 of the pipe hanger so that a side bore 36 in the pipe hanger 30 is arranged coaxially with the primary bore 9 of the wellhead 1. The side bore 36 and the primary bore 9 provide a fluid communication channel from said through bore 34 and through the wall portion of the pipe hanger 30.

The pipe hanger 30 is in its upper portion provided with a well isolation plug, a so-called crown plug 38. The purpose of the crown plug 38 is to close off that portion of the through bore 34 positioned above the side bore 36.

The pipe hanger 30 is provided with two safety valves 42, 44 arranged to be able to close the bore 34 in such as an emergency. The safety valves are of a so-called "fail-safe-closed"-type and have the same purpose as known safety valves arranged in a relative to the wellhead 1 externally arranged christmas tree. Thus, the safety valves 42, 44 are positioned in the wellhead 1 itself instead of being positioned externally to it as has been known so far. The need for an external christmas tree is thus eliminated.

The safety valves 42, 44 are positioned and secured in the desired positions by means of per se known, but not shown positioning and securing devices.

The safety valves 42, 44 are arranged to be remote controlled by means of means known per se. The means are communicated to the safety valves 42, 44 and possibly to other not shown instruments and valves arranged below, i.e. upstream of the pipe hanger 30 though a control bore 50 extending through the pipe hanger 30. The further not shown safety valve, the so-called SCSSV (Surface-Controlled Subsurface Safety Valve) arranged in a manner known per se further down the well, will typically also be controlled through the control bore 50.

A fluid connection between the control bore 50 in the pipe hanger 30 upper portion 31 and lower portion 32 is provided by means of hydraulic connectors known per se arranged in the connecting surfaces of the portions.

The safety valves 42, 44 are in the embodiment shown positioned in the upper portion 31 of the pipe hanger 30. It is however to be understood that the safety valves 42, 44 may be positioned anywhere in the wellhead 1 upstream of the side bore 36. One of the advantages of positioning the safety valves 42, 44 in the upper portion 31 is that the valves 42, 44 may easily be pulled out of the wellhead 1 if there is a need for maintenance or replacement. Said further safety valve will have to be activated before the safety valves 42, 44 are pulled out of a producing well. A person skilled in the art will understand that the sealing sleeve 8, which is also called a high-pressure cap, is removed before the upper portion 31 of the pipe hanger 30 is pulled out of the bore 3 in the wellhead 1.

Because the upper portion 31 and the lower portion 32 constitute the pipe hanger 30 in the embodiment shown, the upper portion 31 may be pulled out of the wellhead 1 independently of the lower portion 32. Thus, the production tubing 9' will by means of the lower portion 32 be able to remain in the well even if the upper portion 31 is pulled out of the well.

To prevent fluids from being able to flow between the external side face of the pipe hanger 30 and the internal surface of the wellhead 1, the pipe hanger 30 is provided with sealing means in the form of packers 46 positioned above as and below the side bore 36. In the embodiment shown the packers 46 are placed in grooves provided in the wall portion of the pipe hanger 30. The packers 46 may be of the elastomer type and/or of the metal-to-metal-type.

Due to the side bore 9 a person skilled in the art will understand that the wellhead 1 according to the present invention provides a possibility to be able to pull such as a production tubing independently of a not shown installation positioned in the extension of the fluid line 15 (see FIG. 1). In the same way it will be possible to handle said installation independently of such as a production tubing. By supporting the installation being connected to the wellhead 1 by a separate foundation, the forces transferred to the wellhead 1 will at least be very much reduced.

By placing the safety valves 42, 44 internally in the wellhead 1 as suggested, the safety valves 42, 44 will thus be well protected against external influences that may be able to influence the functionality of the valves in an adverse way.

In addition the need for a heavy and voluminous christmas tree assembly is eliminated at the same time as the installation procedure becomes simpler and quicker due to the fact that the BOP is positioned to and removed from the wellhead only once, while twice is necessary according to prior art.

The present invention thus provides advantages as regards both safety and cost seen in relation to wellhead solutions according to prior art.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A wellhead for subsea use, configured for working without a Christmas Tree attached, the wellhead comprising:

a body having a bore therethrough and at least one side bore for provision of fluid communication through a wall of the wellhead;

a pipe hanger arranged within the body and provided with a bore therethrough and a side bore being in fluid communication with the side bore of the body, the side bores providing fluid communication between a tubing string connected to the pipe hanger and a fluid line providing fluid communication between the wellhead and a distant installation, having a separate foundation from that of the wellhead; and at least one internal safety valve arranged to be able to shut off fluid communication through the wellhead, where the at least one internal safety valve] provides a second of two well barriers against an external environment and where a first well barrier against the environment is a surface-controlled subsurface safety valve.

2. The wellhead according to claim 1, wherein the at least one internal safety valve is of a type driven to an open position by means of a driving force and closes at reduction in or cessation of the driving force.

3. The wellhead according to claim 1 wherein the at least one internal safety valve is remote controlled.

4. The wellhead according to claim 1, wherein the pipe hanger includes an upper portion and a lower portion arranged to be able to be connected to or disconnected from each other in such a way that the upper portion may be pulled out of or inserted into the wellhead while at the same time the lower portion remains connected to the tubing string.

5. The wellhead according to claim 4, wherein the side bore of the pipe hanger is arranged in the upper portion of the pipe hanger.

6. The wellhead according to claim 5, wherein at least one of the at least one safety valve in the wellhead is positioned in the upper portion of the pipe hanger in such a way that the through bore and the side bore of the pipe hanger may be closed by the safety valve.

* * * * *